US006086151A

United States Patent [19]

Vanharanta

[11] Patent Number: 6,086,151

[45] Date of Patent: Jul. 11, 2000

[54] CHAIR APPARATUS WITH RESILIENT SUPPORT MEMBER

[75] Inventor: Heikki Vanharanta, Helsinki, Finland

[73] Assignee: Vanaranta Consulting Oy, Helsinski, Finland

[21] Appl. No.: 08/818,225

[22] Filed: Mar. 14, 1997

Related U.S. Application Data

[63] Continuation of application No. 08/744,777, Nov. 6, 1996, abandoned.

[51] Int. Cl.[7] ..... A47C 3/025

[52] U.S. Cl. ..... 297/284.1; 297/200; 297/284.3

[58] Field of Search ..... 297/284.1, 284.3, 297/200, 201, 202

[56] References Cited

U.S. PATENT DOCUMENTS

| | | | |
|---|---|---|---|
| D. 182,647 | 4/1958 | Cox | D15/8 |
| 1,795,304 | 3/1931 | Howard . | |
| 2,558,389 | 6/1951 | Robinson | 297/200 |
| 3,192,540 | 7/1965 | Swank | 5/349 |
| 3,296,635 | 1/1967 | O'Hanlan | 5/348 |
| 3,982,786 | 9/1976 | Burgin et al. | 297/284 |
| 3,987,506 | 10/1976 | Markwitz | 5/338 |
| 4,175,297 | 11/1979 | Robbins et al. . | |
| 4,405,129 | 9/1983 | Stuckey | 272/130 |
| 4,796,948 | 1/1989 | Paul et al. . | |
| 5,022,385 | 6/1991 | Harza | 128/33 |
| 5,711,575 | 1/1998 | Hand et al. | 297/284.6 |

FOREIGN PATENT DOCUMENTS

| | | | |
|---|---|---|---|
| 1146460 | 5/1983 | Canada | 297/200 |
| 0311993 | 10/1988 | European Pat. Off. . | |
| 396 883 | 10/1977 | Finland . | |
| 1519843 | 2/1968 | France . | |
| 14608/70 | 11/1972 | Switzerland . | |
| 245881 | 1/1926 | United Kingdom . | |
| 299563 | 11/1928 | United Kingdom . | |
| 958651 | 5/1964 | United Kingdom . | |
| 1432259 | 4/1976 | United Kingdom . | |
| 1541170 | 2/1979 | United Kingdom . | |
| 2026315 | 2/1980 | United Kingdom . | |
| 2191690 | 7/1986 | United Kingdom . | |
| 2252496 | 8/1992 | United Kingdom . | |
| 9210118 | 6/1992 | WIPO | 297/284.3 |
| WO 93/19648 | 10/1993 | WIPO . | |
| WO 94/07396 | 4/1994 | WIPO . | |

*Primary Examiner*—Laurie K. Cranmer
*Attorney, Agent, or Firm*—Choate, Hall & Stewart

[57] ABSTRACT

The device concerns a chair (10), which includes an at least partly resilient seat part (12). The seat part (12) of the chair is provided with support elements (14, 15) placed at both sides of the imaginary longitudinal and vertical centre plane (A) of the seat part, which elements are fitted to produce a force and movement that raises the seat part (12) variably and alternatingly. Favourably, the support elements (14, 15) are interconnected so that, when a substantially vertical load is applied to one support element (14/15), said load produces an increasing support force of a direction opposite to said load in the other support element (15/14). Preferably, the support elements consist of interconnected resilient elements (14, 15) so that, when external, substantially vertical loads of different magnitudes are applied to said resilient elements (14, 15), the resilient element (14/15) that is subjected to a higher load produces a force and movement of opposite direction in the other resilient element (15/14).

9 Claims, 1 Drawing Sheet

CHAIR APPARATUS WITH RESILIENT SUPPORT MEMBER

This application is a continuation of application U.S. Ser. No. 08/744,777 now abandoned filed Nov. 6, 1996, the entire contents of which are incorporated herein by reference.

The invention concerns a chair, which includes an at least partly resilient seat part. which is provided with support elements placed at both sides of the imaginary longitudinal and vertical centre plane of the seat part, which elements are fitted to produce a force and movement that raises the seat part variably and alternatingly.

In normal population, prolonged sitting often causes a disagreeable sensation in the back, backache and numbness of the back and of the lower limbs. In back patients, these symptoms are provoked more rapidly. These symptoms do not arise if sitting is interrupted in between by standing up for some time. Similar symptoms do not arise at all if the person moves and stands appropriately unless a serious back disease is concerned that congests the spinal canal.

In a closer examination of the background of the invention, it can be stated that both experimental and clinical observations clearly point at the fact that lack of motion is detrimental to the preservation of the capacity of loading of the tissues in supportive organisms. For example, if a joint is immobilized by means of splints, changes similar to degenerative arthritis arise in the joint, and lack of loading again results in deterioration of the cartilage tissue. In patient materials it has been established quite convincingly that such groups of people, for example professional car or lorry drivers, as have to sit on their seat for long times run an exceptionally high risk of obtaining a herniated intervertebral disk. As early as around the change of the 70's and 80's, it was established by means of studies that healing of cartilage damage can be promoted by producing motion and slow changes of loading in the joint. Later, it has been established that the medium synthesis in the cells in the tissues is stimulated in a slowly varying movement, most obviously because the motion keeps the pH level in the tissue in a range optimal in view of the cell synthesis. The quality and quantity of the medium produced by the cell are decisive when it is considered why a tissue endures loading. Motion promotes both elimination of the acid waste products arising as a result of combustion of the cell medium and, on the other hand, it also supplies necessary nutrition to the cells. In the intervertebral disk, motion obviously has a very high significance, because the intervertebral disk is the largest tissue with no blood vessels in the body, and its nutrition takes place to quite a great extent by means of diffusion, said diffusion being, thus, promoted by motion.

In addition to the circumstances of the cell level discussed above, right in some of the recent years, more information has been obtained to the effect that the circulation of blood in the veins in the spine and especially in the spinal nerves has an obvious part in the generation of back symptoms. As a rule, the blood in the veins is pumped by the effect of motion and muscular work up back to the heart. Normally, as motion is eliminated during sitting by supporting the sitting person in the chair, the veins in the backbone and especially in the nerves start being filled gradually. In the bony spinal canal, there is, however, quite a limited space, and therefore the pressure in the veins becomes gradually higher and higher and successively produces a disagreeable sensation. It has been even noticed that the generated pressure in the veins can become even high enough so that it exceeds the arterial pressure if there is also bony congestion in the spine. In such a case, the supply of nutrition to the nerve root is prevented. Normally a person also moves while he or she is seated, but when attentiveness is required, for example when driving a car or lorry, in a theatre, concert, in a working chair, etc., or if the space for movement is restricted, such as in a tourist class seat in an airplane, motion is reduced and these disagreeable symptoms described above tend to arise.

During prolonged sitting in an "ordinary" chair, the person himself has to do a lot of work, i.e. to twist himself, in order that the back should be brought into the necessary motion. In the other respects, regarding the prior art, for example, the following solutions of earlier date should be cited. In the PCT publication WO 93/19648, a seat is described whose function is to activate the muscles and ligaments. In said seat, this objective has been achieved so that the seat has been made labile and, moreover, it has also been provided with springs in the vertical direction. As a result of the spring system and of the tilting joint of the seat part described in said paper, the seat is really swinging and highly unstable, and the movements that take place during sitting are therefore very quick and uncontrollable, taking place even several times per second, unless the seated person restricts them by means of active muscular work. Owing to the construction and mode of operation of the seat, the muscular system of the seated person is constantly in an activated state, because, in order that he could retain his balance and prevent slipping, the seated person must do a lot of work against the movement produced by gravitation. The construction of the seat described in the paper WO 93/19648 is quite special and complicated and includes a number of springs, sets of articulated joints and equivalent, so that it can hardly be even imagined to use a seat in accordance with said paper as a seat in a vehicle, airplane or, for example, in a concert hall. Thus, the purpose of use of said seat is quite restricted.

As included in the prior art, the PCT publication WO 94/07396 can also be stated, which concerns a cushion for a chair, which is meant for seriously handicapped persons, such as wheel-chair patients, who must sit in their chair constantly. The function of this chair cushion is to prevent so-called bedsore so that the areas of loading of the skin are changed cyclically. The air-cushion construction of the chair cushion comprises a number of air tubes, into and out of which air is blown alternatingly. The air is blown into the tubes by means of an air pump, so that a so-called positively operated system is concerned. Attempts are not made to produce motion by means of the cushion itself, and the air tubes in the cushion have not been designed for this purpose. The air tubes are placed in the area of the entire chair cushion, not just in the area of the buttocks or of the ischial tuberosities. The ischial tuberosity is the very area in the buttock in which the formation of bedsore constitutes a risk. Bedsore arises if the load on the skin above the ischial tuberosity remains high constantly, thus obstructing the circulation of blood in the skin. The problem is constituted exactly by patients with paralysis, who lack the sense of feeling in the body and who, thus, do not receive sensations in order to vary the load or who are incapable of such variation because of the paralysis.

The seat described in said publication varies the area of loading and centrally increases the area that is loaded. Thus, the air cushion extends across the area of the entire chair cushion, also below the thighs. The pressure produced by gravitation is higher below the ischial tuberosity than below the thigh. Thus, when the air cushion is filled, the load below the thigh is lower than in the area of the ischial tuberosity, and the equal pressure in the air cushion in the area of the thigh raises the thigh to a greater extent than it raises the region of the ischial tuberosity. This is why it is fully obvious that the device in accordance with said publication does not produce any movement in the spine but possibly just a slight movement of the thigh. This movement of the thigh in the opposite direction would, as a matter of fact, be harmful to the venous circulation of blood flowing from the lower limbs. In its own function, the device of said publication most obviously operates exactly in the way for which it has been designed. A solution of rather similar type is also described in the U.S. Pat. No. 4,175,297.

Finally, as included in the prior art, the GB Patent 2,252,496 is cited, which concerns an air cushion construction intended for the back of a chair and comprising two inflatable air chambers, one chamber at each side of the longitudinal axis of the chair. The function of this inflatable cushion of two parts is to support and also to produce motion in the spinal curve in the lower portion of the back. The design of the air cushion of said GB paper as consisting of two parts comes from the fact that an attempt has been made to avoid contact between the air cushion and the backbone, as the backbone is placed in the middle of the back and its projections (spinous processes) usually meet the back of the chair. Thus, the support cushion in accordance with the GB paper is in contact with the muscles more than with the backbone. The cushion is connected with a pump, which cyclically fills and empties said cushion. The device does not produce a movement of rotation or lateral bending in the backbone.

Finally, with regard to the prior art, reference can be made to the publications CH-530 778, SE-396 883, EP-311 993, U.S. Pat. No. 4,796,948 and GB-2 026 315. In said publications, different solutions relating to seats, beds and treatment supports based on mechanics and pneumatics, are described, which solutions, however, due to their function and construction are not applicable for the same purpose as the present invention.

The object of the present invention is to provide a novel chair by whose means symptoms of numbness arising from prolonged sitting are avoided and by whose means such motion is produced in the lumbar region in the backbone of the seated person that the conditions of pain or the disagreeable sensations described above do not occur.

In view of achieving this, the invention is mainly characterized in that the support elements are fitted side by side in the seat part substantially exclusively in the area that is intended for the ischial tuberosities of the buttocks of the seated person, and that the support elements are interconnected so that, when a substantially vertical load is applied to one support element, said load produces a slowly increasing support force of a direction opposite to said load in the other support element.

The support elements preferably consist of interconnected resilient elements or equivalent constructions so that, when external, substantially vertical loads of different magnitudes are applied to said resilient elements or equivalent, the resilient element that is subjected to a higher load produces a force and movement of opposite direction in the other resilient element.

Compared with the prior art, the present invention provides a number of significant advantages, of which the following should be stated here. For example, compared with the PCT paper WO 93/19648, the chair in accordance with the present invention provides the remarkable advantage that the chair of the present invention provides a slow, controlled, alternating movement taking place towards the sides from one side to the other and simulating very slow walting, by means of which movement attempts are not at all made to activate the muscles but just to produce relatively considerable bending movements in the backbone. Further, compared with said publication, the present invention provides the advantage that the seat part of the chair is steady and continuous like in ordinary chairs, so that it can be applied and carried out for highly different purposes by simple means. Compared with the PCT paper WO 94/07396, the present invention provides, for example, the advantage that the resilient elements by whose means the movement in accordance with the invention is carried into effect are placed in the seat at such a location at which the effect produced by them is optimal without producing a load underneath the thigh. Moreover, compared with all of the prior-art papers discussed above, with the exception of the PCT paper WO 93/19648, the present invention provides the advantage that an external source of energy is not needed, even if such a source can be used. The other advantages and characteristic features of the invention come out best from the following detailed description of a preferred embodiment of the invention.

In the following, the invention will be described by way of example with reference to the figures in the accompanying drawing.

Figure 1:
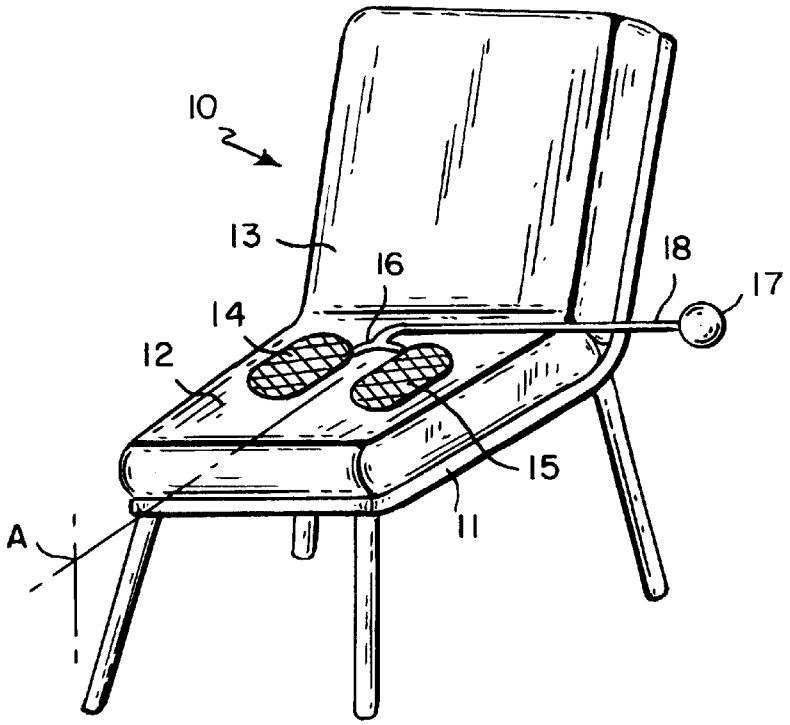
FIG. 1 is a schematic perspective view of a preferred embodiment of a chair in accordance with the present invention.

In the figures in the drawing, the chair is denoted generally with the reference numeral 10. In the normal way, the chair 10 shown in the figures comprises a frame part 11, which includes legs, as well as a cushioned seat part 12 and a cushioned back part 13. The longitudinal and vertical centre plane of the chair 10 is denoted schematically with the reference A. It is the starting point and the basic idea of the chair 10 in accordance with the invention that, on one hand, the seat part 12 of the chair 10 is, in a way, divided into two "halves" in relation to its longitudinal centre plane A, i.e. a left and a right half 12*a* and 12*b*, even though, in the exemplifying embodiment shown, the seat part 12 is continuous, and, on the other hand, it is included in the basic idea that said left and right halves 12*a*, 12*b* can be brought into an alternating upward and downward movement of opposite directions, which movement has the effect that the sitting person's buttocks rise and sink alternatingly. Technically such a movement can be accomplished in a number of different ways, but in the figures in the drawing just one of these modes is illustrated, which embodiment is considered to be the preferred one at present. In the solution as shown in the figures in the drawing, the rising and sinking movement of the seat 12 halves 12*a*, 12*b* has been produced so that, in the seat part 12, on the halves 12*a*, 12*b* placed at each side of the centre plane A, support elements 14, 15 have been installed, which are fitted to produce a force and a movement that raises the seat part 12 in a varying and alternating way.

The support elements 14, 15 are interconnected so that, when a substantially vertical load is applied to one support element 14/15, said load produces an increasing support force of a direction opposite to the direction of said load and applied to the other support element 15/14.

Preferably, the support elements 14, 15 are composed of interconnected resilient elements 14, 15 or of equivalent structures, and in the exemplifying embodiment shown in the figures, the resilient elements 14, 15 that are used are resilient containers that can be filled with a pressure medium, for example bags 14, 15. These resilient containers 14, 15 are interconnected by means of a connecting hose 16 or equivalent, through which, when one resilient container 14 is emptied, the pressure medium can flow into the other resilient container 15, placed at the opposite side of the centre plane, and fills said container. The pressure medium is preferably air, but also other gases or a liquid can be used as a pressure medium. In FIG. 1, it is shown farther that the resilient containers 14, 15 are connected through a feed hose 18 with a pump or equivalent, which is denoted schematically with the reference numeral 17 and by whose means the pressure in the resilient containers can be regulated in the desired way.

Figure 2:
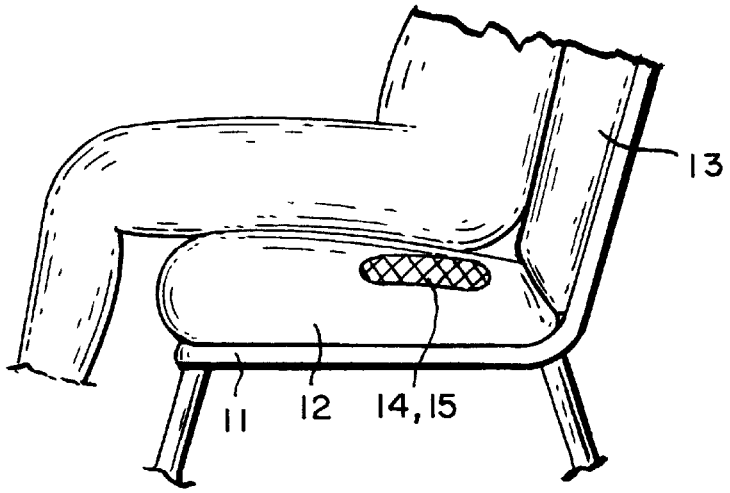
FIG. 2 is a schematic side view of a preferred embodiment of a chair in accordance with the invention.

The desired effect and the alternating upward and downward movement of the chair 10 or, more specifically, of its seat part 12 is based on the fact that, as a rule, a person unintentionally alternates the buttock or, more correctly, the ischial tuberosity with which he presses the seat to a greater extent. In the invention, this has been utilized so that, in the solution shown in FIGS. 1 and 2, this spontaneous alternation reverses the flow direction in the connection hose 16 interconnecting the resilient containers 14, 15. As is illustrated in FIG. 2, in the chair 10 of the present invention, the resilient elements 14, 15 are fitted exclusively below the ischial tuberosities so that they do not load the thighs of the seated person. When the resilient elements, such as air cushions 14, 15, are interconnected in the way in accordance with the invention and when the seated person loads one air cushion by means of his ischial tuberosity to a greater extent than the other, the movement of the backbone starts.

In the exemplifying embodiment shown in the drawing, the connecting hose 16 that interconnects the air containers 14, 15 can be provided with a valve (not shown), in which case the speed of the movement can be adjusted by means of such a valve individually for each seated person. Of course, the weight of the seated person affects the speed of the movement. As was already stated above, by means of the chair 10 in accordance with the invention, a slow movement that alternates in a controlled way is supposed to be produced. As a suitable speed of movement, it is possible to consider a speed in which the direction of the movement is reversed after intervals of about 1 to 60 seconds.

Above, it was also already stated that no external source of energy is required to produce the movement, Such a source of energy can, of course, be connected to the construction if it is considered necessary. The simplest way of accomplishing the present invention is by means of the air cushion solution shown in the figures. The air bags 14, 15 shown in the figures can, however, also be substituted for by other. resilient elements if such elements can be interconnected in a suitable way so as to produce an alternating movement.

The advantages of the invention were already described above, but in this connection it should still be stated that, as can also be seen from the figures, in principle, the solution in accordance with the present invention can be applied to almost any existing seat whatsoever. Further, when the air cushion solution shown in the figures is used, the chair can be converted to a seat that behaves fully in the way of a "normal" cushioned chair after the pressure has been discharged from the air cushions 14, 15.

Above, the invention has been described by way of example with reference to the figures in the accompanying drawing. The invention is, however, not confined to the exemplifying embodiment shown in the figures alone. As a further embodiment, it should be stated in this connection that the construction shown in the figures is also applied to the back of the chair 10, in which case the motion of the backbone can be intensified further. Further embodiments of the invention may show variation within the scope of the inventive idea defined in the accompanying patent claims.

I claim:

1. A chair, which includes an at least partly resilient seat part (12), which is provided with support elements (14, 15) placed at both sides of an imaginary longitudinal and vertical centre plane (A) of the seat part, which elements are fitted to produce a force and movement that raises the seat part (12) variably and alternatingly, characterized in that the support elements (14, 15) are fitted side by side in the seat part (12) substantially exclusively in the area that is intended for the ischial tuberosities of the buttocks of the seated person so that they do not load the thighs of the seated person, and that the support elements (14, 15) are interconnected so that, when a substantially vertical load is applied to one support element (14, 15), said load produces a slowly increasing support force in a direction opposite to said load in the other support element (15/14), the chair further characterized in that the support elements comprise interconnected resilient elements (14, 15) so that, when external, substantially vertical loads of different magnitudes are applied to said resilient elements (14, 15), the resilient element (14/15) that is subjected to a higher load produces a force and movement of opposite direction in the other resilient element (15/14), and the chair further characterized in that the speed of the movement produced by an external load in the resilient elements (14, 15) is adjustable.

2. The chair as claimed in claim 1, characterized in that the resilient elements comprise resilient containers (14, 15) that can be filled with a pressure medium.

3. The chair as claimed in claim 2, characterized in that the resilient containers (14, 15) comprise bags, which are interconnected through a connecting hose (16), through which hose the pressure medium can flow at the desired velocity from one container into the other while reversing its flow direction alternatingly.

4. The chair as claimed in claim 3, characterized in that, in the connecting hose (16) interconnecting the resilient containers (14, 15), a valve is provided, by whose means the flow velocity of the pressure medium in the connecting hose (16) can be regulated.

5. The chair as claimed in claim 3, characterized in that the hose is adapted to slow pressure medium flow such that the slowly increasing force is applied for a time period of between 1 and 60 seconds.

6. The chair as claimed in claim 4, characterized in that the resilient containers (14, 15) are connected with a source of pressure (17), by whose means the containers (14, 15) can be pressurized to the desired pressure.

7. The chair as claimed in claim 4, characterized in that, in the connecting hose (16) interconnecting the resilient containers (14, 15), a valve is provided, by whose means the flow velocity of the pressure medium in the connecting hose (16) can be regulated.

8. A seat for moving the buttocks and the backbone of a seated person, comprising:

a first resilient support element oriented under an area intended for one half of the buttocks of the seated person so that it does not load the thighs of the seated person;

a second resilient support element oriented under an area intended for the other half of the buttocks of the seated person so that it does not load the thighs of the seated person;

a connector joining the first support element with the second support element for providing fluid communication between the first and second support elements, the connector including a connecting hose adapted to slow the fluid flow from one support element to the other, and the connecting hose including a valve for adjustably slowing the fluid flow from one support element to the other; and a fluid contained within the support elements for transmitting an alternating and variable force from one support element to the other support element, whereby application of a substantially vertical load to one of the support elements produces a slowly increasing force in a direction opposite to said load in the other support element thereby moving the backbone of the seated person.

9. The seat according to claim 8, wherein the valve adjustably slows the fluid flow such that the slowly increasing force is applied for a time period of between 1 and 60 seconds.

* * * * *